US008210836B2

(12) United States Patent
Schneider et al.

(10) Patent No.: US 8,210,836 B2
(45) Date of Patent: Jul. 3, 2012

(54) VANE CELL PUMP WITH ADJUSTABLE OUTPUT

(75) Inventors: Willi Schneider, Bodelshausen (DE); Torsten Helle, Tuebingen (DE); Dirk Ehrenfeld, Reutlingen (DE)

(73) Assignee: Joma-Hydromechanic GmbH, Bodelshausen (DE)

( * ) Notice: Subject to any disclaimer, the term of this patent is extended or adjusted under 35 U.S.C. 154(b) by 100 days.

(21) Appl. No.: 11/846,006

(22) Filed: Aug. 28, 2007

(65) Prior Publication Data

US 2007/0292291 A1 Dec. 20, 2007

Related U.S. Application Data

(63) Continuation of application No. PCT/EP2006/007943, filed on Aug. 11, 2006.

(30) Foreign Application Priority Data

Oct. 6, 2005 (DE) ..... 10 2005 048 602
Apr. 28, 2006 (DE) ..... 10 2006 021 251

(51) Int. Cl.
*F01C 20/18* (2006.01)
*F04C 2/00* (2006.01)
*F04C 14/18* (2006.01)
*F04C 28/18* (2006.01)

(52) U.S. Cl. ..... 418/26; 418/27; 418/30; 417/220

(58) Field of Classification Search ..... 418/24–27, 418/29–31; 417/220
See application file for complete search history.

(56) References Cited

U.S. PATENT DOCUMENTS 2,142,275 A * 1/1939 Lane ..... 418/26
2,250,947 A 7/1941 Carpenter, Jr.
2,628,567 A * 2/1953 De Lancey et al. ..... 418/26
2,952,215 A * 9/1960 Deschamps ..... 418/26
3,223,046 A 12/1965 Eickmann
3,637,332 A * 1/1972 McAnally, III ..... 418/159
3,650,180 A * 3/1972 Gantschnigg et al. ..... 91/488
(Continued)

FOREIGN PATENT DOCUMENTS

CN 1439079 8/2003
(Continued)

OTHER PUBLICATIONS

International Search Report, for PCT/EP2006/007943 mailed Nov. 27, 2006.

*Primary Examiner* — Mary A Davis
(74) *Attorney, Agent, or Firm* — Brinks Hofer Gilson & Lione

(57) ABSTRACT

The disclosure relates to a vane cell pump having an external rotor, an internal rotor and a plurality of vanes which are secured in a pivotable manner on the external rotor and which are displacably mounted in a radial manner in the inner rotor, essentially in radial slots. The external rotor is guided along the inner circumferential surface of a stator. The axis of the stator and the axis of the internal rotor are offset in relation to each other, and the stator can be adjusted in the radial direction in relation to the internal rotor and can be modified by the offset. Said stator is partially enclosed by a clamp which is mounted in a pivotable bearing in the housing of the vane cell pump. The clamp includes clamp arms which protrude on both sides of the pivotable bearing, which partially enclose, respectively, the stator.

7 Claims, 3 Drawing Sheets

U.S. PATENT DOCUMENTS

| | | | | | |
|---|---|---|---|---|---|
| 3,744,939 | A | * | 7/1973 | Grennan et al. | 418/30 |
| 4,764,095 | A | * | 8/1988 | Fickelscher | 418/31 |
| 5,090,881 | A | * | 2/1992 | Suzuki et al. | 418/26 |
| 5,484,271 | A | * | 1/1996 | Stich | 418/26 |
| 5,490,770 | A | * | 2/1996 | Oogushi | 418/27 |
| 5,690,479 | A | * | 11/1997 | Lehmann et al. | 418/26 |
| 5,752,815 | A | * | 5/1998 | Muller | 418/26 |
| 5,800,131 | A | * | 9/1998 | Lehmann et al. | 417/220 |
| 7,540,729 | B2 | * | 6/2009 | Schneider | 418/173 |
| 7,736,134 | B2 | * | 6/2010 | Schneider | 418/26 |
| 7,785,087 | B2 | * | 8/2010 | Schneider | 418/26 |
| 2006/0191360 | A1 | * | 8/2006 | Beez | 74/25 |

FOREIGN PATENT DOCUMENTS

| | | | | | |
|---|---|---|---|---|---|
| DE | 4014636 | A1 | * | 7/1992 | 418/24 |
| DE | 43 07 003 | A1 | | 9/1993 | |
| DE | 195 04 220 | A1 | | 8/1996 | |
| DE | 195 32 703 | C1 | | 11/1996 | |
| DE | 196 31 974 | A1 | | 2/1998 | |
| EP | 0 049 838 | | | 10/1981 | |
| EP | 0 095 194 | A | | 11/1983 | |
| WO | WO 2007/039012 | A1 | | 4/2007 | |

* cited by examiner

VANE CELL PUMP WITH ADJUSTABLE OUTPUT

CROSS-REFERENCE TO RELATED APPLICATIONS

This application is a continuation of International Application No. PCT/EP2006/007943 filed on Aug. 11, 2006, which claims the benefit of German Patent Application No. 10 2005 048 602.9, filed Oct. 6, 2005 and German Patent Application No. 10 2006 021 251.7, filed Apr. 28, 2006. The disclosures of the above applications are incorporated herein by reference.

FIELD

The present disclosure relates to vane cell pumps.

BACKGROUND

The statements in this section merely provide background information related to the present disclosure and may not constitute prior art.

DE 100 40 711 A1 discloses a vane cell pump with a ring-shaped inner rotor in which a plurality of vane elements extending radially outward is housed in a radially displaceable manner. The radially inner end areas of the vane elements abut a non-rotatable central part, while the radially outer lying end areas abut a non-rotatable outer ring. The rotor can be turned on a rotational axis that is offset from the center axis of the central part and the outer ring. As a result, feed cells of initially increasing volume followed by those of decreasing volume form between the vane elements when the rotor is rotated. The volume change of the feed cells causes fluid to be first suctioned into the feed cells and then discharged back out. The end areas of the vane elements glide on either the central part or the outer ring according to their positions. A vane cell pump of this type can be manufactured easily and economically.

For the purpose of increased efficiency, DE 195 32 703 C1 discloses a vane cell pump in the form of a reciprocating vacuum pump. In this pump, the vane elements are displaceably housed in an inner rotor, while at the same time they are pivotably held in a ring-shaped external rotor. The rotational axis of the inner rotor is offset from the rotational axis of the external rotor; this results in feed cells initially increasing in volume and then decreasing in volume as described previously. The reciprocating vacuum pump described in DE 195 32 703 C1, however, is complex and therefore expensive to manufacture.

SUMMARY

The present disclosure provides a vane cell pump in which pump output can be more finely adjusted.

According to one form of the disclosure, the problem can be solved with a vane cell pump of the type initially mentioned if the clamp features clamp arms protruding on both sides of the pivotable bearing and if each clamp arm partly encloses the stator.

The inventive configuration of the vane cell pump makes it possible for the stator to be moved not only by means of a single clamp arm, for which purpose the stator must be fixedly connected to the clamp arm, but rather to have the stator surrounded by both of the clamp arms, which enclose it in a fork-like manner. Thus in a particular embodiment, pressure can be applied to only one of the clamp arms, while the other clamp arm is driven by other means, e.g. by means of a spring. In another embodiment, it is also possible to have pressure applied to both of the clamp arms, thereby allowing the position of the stator to be determined by the two pressures. This allows very fine adjustment or positioning of the stator to be achieved, which is required for the characteristic diagrams.

Because the two clamp arms of the stator are driven in opposite directions, the smallest changes in pressure can be taken into consideration when positioning the stator. In particular, it is not necessary to work against a spring constant, which has the disadvantage that work must be performed against a changing spring force, i.e. against a spring constant. The incidental pressures for displacing the stator can be used directly, namely in both directions.

In a further refinement of the present disclosure, it is provided that both of the clamp arms can be hydraulically or pneumatically pivoted. In this scenario, the oil pressure prevailing in the system, for example, can be used for controlling the clamp arms. For pneumatic systems, the prevailing pressure or vacuum pressure can be used in the same way.

In a further refinement of the embodiment, it is provided that a clamp arm can be pivoted by means of a spring. A particular variant provides that the stator can be adjusted by means of a spring. This spring, in particular a pretensioned spring, has the task of shifting the clamp and/or the stator in the direction of maximum pump displacement, i.e. either maximum pressure or maximum vacuum pressure. This is necessary if the pneumatic or hydraulic control of the clamp arms fails in the event of a power outage. Controlling the clamp by means of the mechanical spring ensures that the system is supplied with the required hydraulic or pneumatic pressure or pneumatic vacuum pressure. Here the spring can be a coil spring, flat spring, torsion spring or even a pneumatic cushion.

To achieve the simplest manner of clamp arms control, the invention provides that the free ends of the clamp arms feature piston surfaces for a pressure medium. Adjustment force can be determined based on the size of the piston surfaces, allowing the available pressure to be directly routed to the piston surfaces.

In one form, the piston surfaces are displaceably mounted in guides provided in the housing of the vane cell pump. On the one hand, these guides serve the purpose of sealing pistons from the housing, while on the other hand they provide precise guidance and bearing of the free ends of the clamp arms.

Additional advantages, features and details of the invention can be found in the sub-claims as well as in the following description in two preferred embodiments that are described in further detail with reference being made to the attached drawing. The features illustrated in the drawings as well as those mentioned in the claims and descriptions can also be employed on their own or in a desired combination while remaining within the scope of the present disclosure.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

In order that the invention may be well understood, there will now be described an embodiment thereof, given by way of example, reference being made to the accompanying drawing, in which.

DETAILED DESCRIPTION

The following description is merely exemplary in nature and is not intended to limit the present disclosure, application, or uses.

To better clarify the present disclosure, reference is made to DE 10 2005 048 602, the contents of which have been incorporated by reference herein in their entirety.

Figure 1:
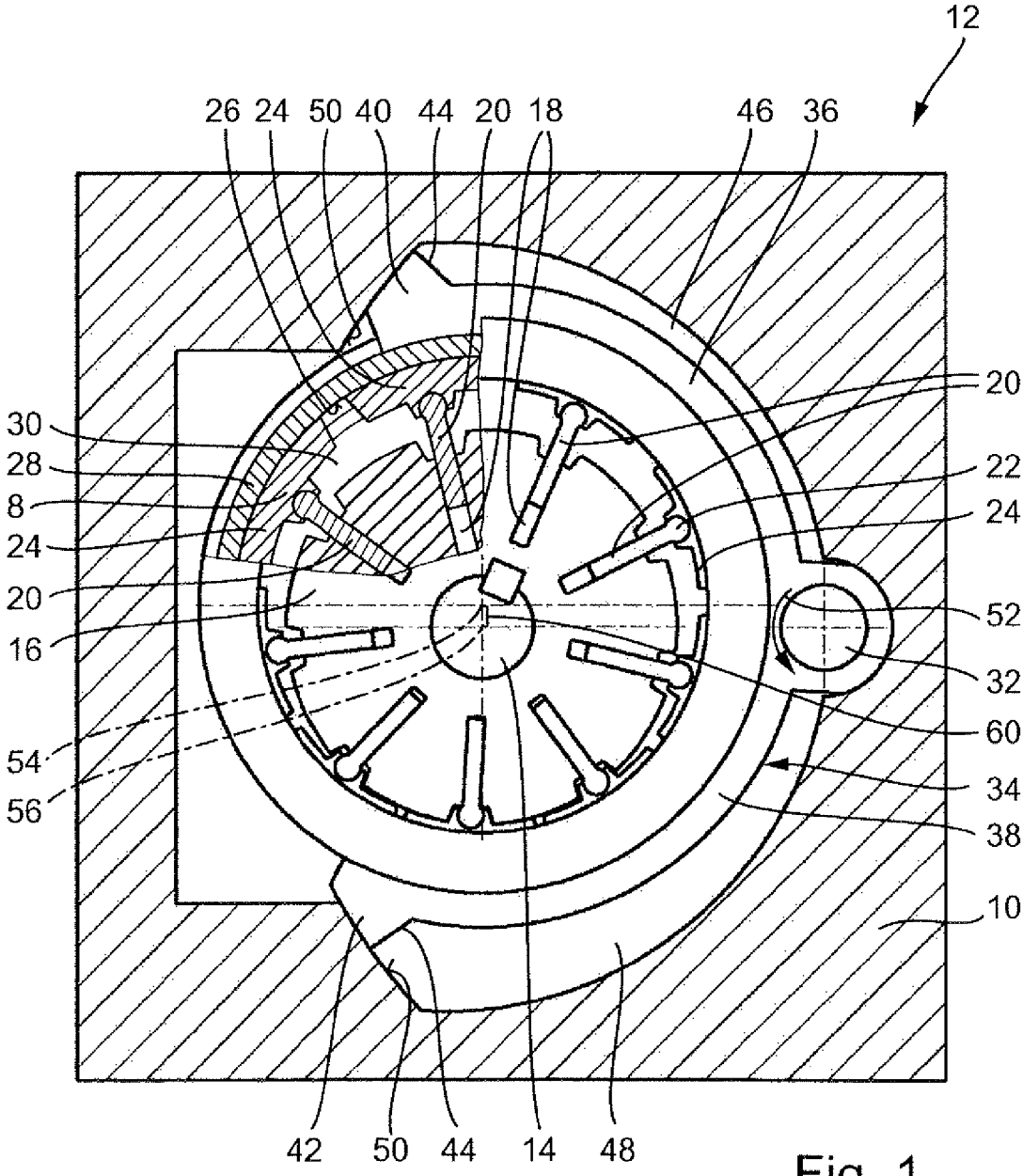
FIG. 1 is a cross section through a vane cell pump, partly cut-away.

FIG. 1 is a schematic illustration of a housing 10 of a labeled vane cell pump 12 in which a drive shaft 14 is rotatably mounted. This drive shaft 14 drives an inner rotor 16, which features a plurality of radial slots 18, in which vanes 20 are displaceably mounted in a radial manner. These vanes 20 feature a thickened free end 22 on which guiding blocks 24 are pivotably mounted. These guiding blocks 24 abut the inner circumferential surface 26 of a stator 28 and form an external rotor labeled 8. The inner rotor 16, two vanes 20, two guiding blocks 24 as well as the stator 28 each form a working chamber 30. This is clearly visible in the cut-away section of the vane cell pump 12 in FIG. 1. The working chamber 30 increases and decreases in volume as the inner rotor 16 rotates, thereby causing a fluid to be displaced.

Figure 2:
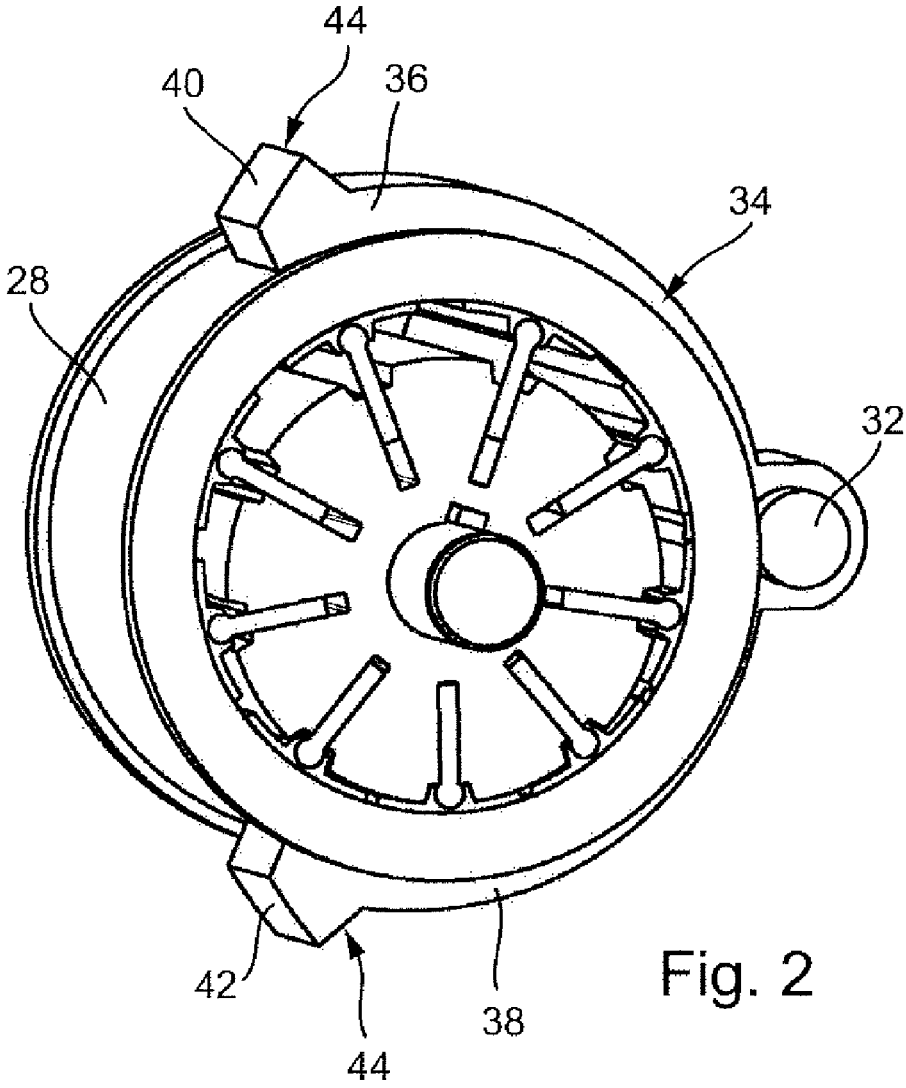
FIG. 2 is a perspective view of a vane cell pump without a housing according to a first embodiment.

It is also visible from FIG. 1 that a fork-shaped clamp 34 is pivotably mounted in a pivotable bearing 32 fixedly connected to the housing, where the clamp 34 features two clamp arms 36 and 38, which abut the stator 28 and enclose it at least partly. This is also clearly visible in FIGS. 2 and 3. The free ends 40 and 42 of the clamp arms 36 and 38 feature piston surfaces 44 that are acted upon by a fluid prevailing in pressure chambers 46 and 48. The clamp arms 36 and 38 are placed in guides 50, which seal off the clamp arms from fluid and where the guides 50 constitute cylindrical surfaces.

If a pressure acts upon, for example, the piston surface 44 of the free end 40 of the clamp arm 36, the clamp arm 36 and thus the entire clamp 34 are pivoted on the pivot axis of the pivotable bearing 32 in the direction of the arrow 52, thereby causing the stator 28 to be moved in the direction of the arrow. In the location illustrated in FIG. 1, the stator 28 features an axis 56 that involves an offset 60 in relation to the axis 56 of the drive shaft 40. When the stator 28 is displaced in the direction of the arrow 52, this offset 60 decreases and the eccentricity of the inner rotor 16 in relation to the stator 28 or external rotor 8 decreases as a result, thereby reducing the working volume of the vane cell pump 12.

Working volume is increased if a pressure is applied to the piston surface 44 of the end 42 of the clamp arm 38, thereby causing the clamp 34 to pivot against the direction of the arrow 52. The resulting force of the pressures prevailing on the piston surfaces 44 then acts on the clamp 34.

Figure 3:
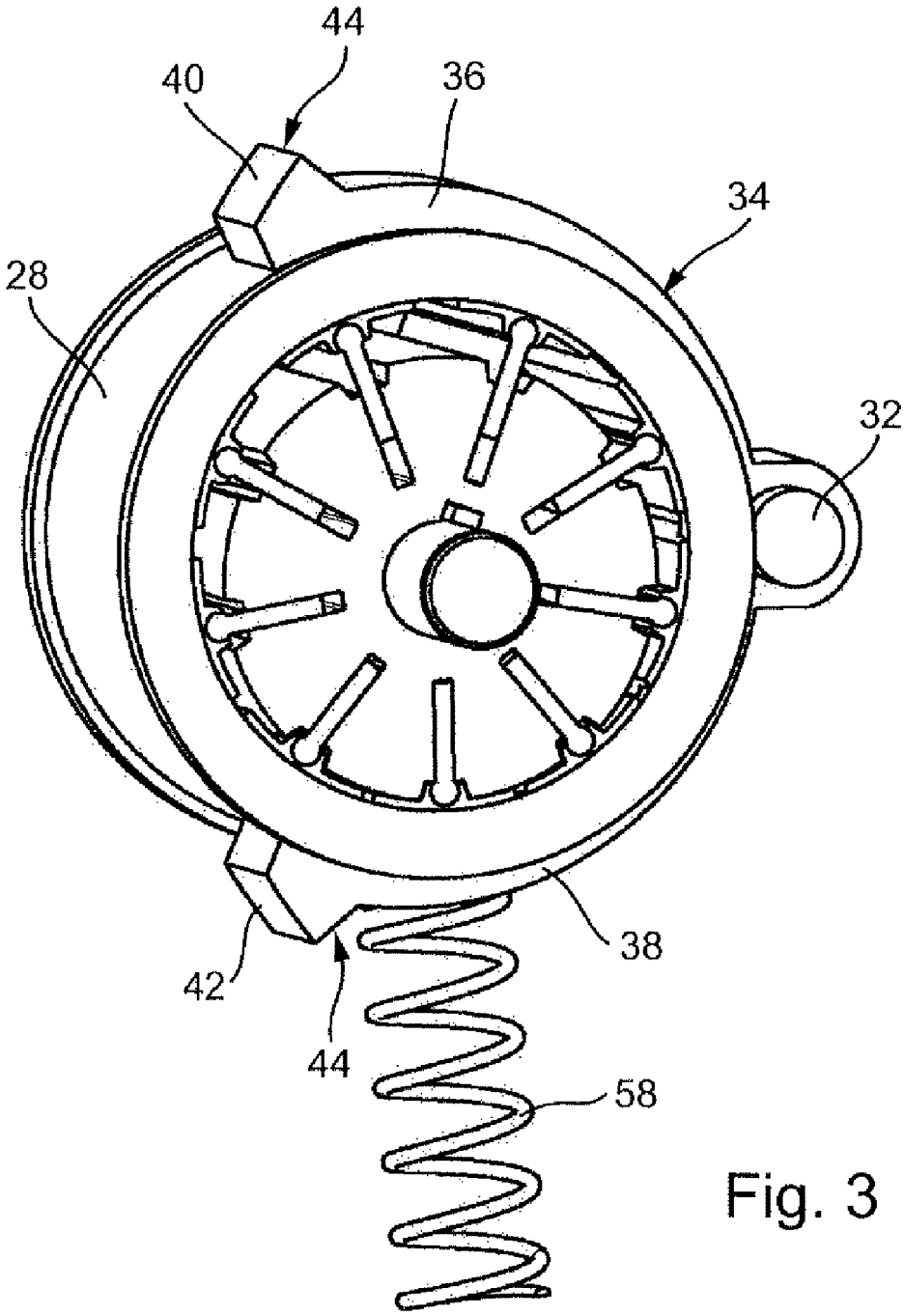
FIG. 3 is a perspective view of a vane cell pump without a housing according to a second embodiment.

In the embodiment illustrated in FIG. 3, a mechanical spring 58, in particular a coil spring, which works to shift the stator 28 against the direction of the arrow 52, acts on the underside of the stator 28 in a suited manner. This displacement direction acts in the direction of maximum output of the vane cell pump 12.

If in the event of a malfunction, pressure is absent at both the piston surface 44 of the clamp arm 36 and at the piston surface 44 of the clamp arm 39, the stator 28 is always displaced in the direction of maximum output, which ensures that the vane cell pump 12 furnishes either a sufficient amount of fluid to be displaced or a sufficient vacuum pressure. This spring 58 serves only for adjusting the vane cell pump 12 in the event of a malfunction. Under normal conditions, the stator 28 is returned to the direction of maximum displacement through the application of pressure to the piston surface 44 of the clamp arm 38 or by decreasing pressure on the piston surface of clamp arm 36.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A vane cell pump comprising an external rotor, an inner rotor and a plurality of vanes, which are displaceably mounted in a radial manner in essentially radial slots in the inner rotor and which are secured in a pivotable manner on the external rotor and the external rotor is guided along the inner circumferential surface of a stator, where the axis of the stator and the axis of the inner rotor are offset in relation to one another and where the stator can be adjusted in a radial direction in relation to the inner rotor thereby allowing the offset to be modified, and the stator is partially enclosed by a clamp which is mounted in a pivotable bearing in the housing of the vane cell pump, characterized by the fact that the clamp comprises clamp arms which protrude on both sides of the pivotable bearing to partly enclose, respectively, the stator, the clamp arms being discontinuous by having free ends that comprise piston surfaces for a pressure medium, in which pressure chambers are formed between the pivotable bearing and the piston surfaces, wherein the piston surfaces are displaceably mounted in guides provided in the housing of the vane cell pump.

2. The vane cell pump as claimed in claim 1, characterized by the fact that the clamp is fork-shaped due to its clamp arms.

3. The vane cell pump as claimed in claim 1, characterized by the fact that both of the clamp arms can be pivoted by at least one of hydraulically and pneumatically.

4. The vane cell pump as claimed in claim 1, characterized by the fact that a clamp arm can be displaced by means of a spring.

5. The vane cell pump as claimed in claim 4, characterized by the fact that the spring is pretensioned.

6. The vane cell pump as claimed in claim 4, characterized by the fact that the clamp arms and/or the stator can be adjusted in the direction of maximum output of the vane cell pump by means of the spring.

7. The vane cell pump as claimed in claim 1, characterized by the fact that the stator can be adjusted by means of a spring.

* * * * *